US011473801B2

(12) United States Patent
Wang et al.

(10) Patent No.: US 11,473,801 B2
(45) Date of Patent: Oct. 18, 2022

(54) MULTI-SPLIT SYSTEM AND METHOD AND APPARATUS FOR ADJUSTING OIL VOLUME OF COMPRESSOR OF MULTI-SPLIT SYSTEM

(71) Applicants: GD MIDEA HEATING & VENTILATING EQUIPMENT CO., LTD., Foshan (CN); MIDEA GROUP CO., LTD., Foshan (CN)

(72) Inventors: Mingren Wang, Foshan (CN); Kun Yang, Foshan (CN)

( * ) Notice: Subject to any disclaimer, the term of this patent is extended or adjusted under 35 U.S.C. 154(b) by 441 days.

(21) Appl. No.: 16/626,573

(22) PCT Filed: Nov. 8, 2018

(86) PCT No.: PCT/CN2018/114618
§ 371 (c)(1),
(2) Date: Dec. 26, 2019

(87) PCT Pub. No.: WO2019/091432
PCT Pub. Date: May 16, 2019

(65) Prior Publication Data

US 2020/0200403 A1 Jun. 25, 2020

(30) Foreign Application Priority Data

Nov. 10, 2017 (CN) ..... 201711106179.9

(51) Int. Cl.
*F24F 11/49* (2018.01)
*F04B 39/02* (2006.01)
(Continued)

(52) U.S. Cl.
CPC ..... *F24F 11/49* (2018.01); *F04B 39/0207* (2013.01); *F24F 1/0003* (2013.01);
(Continued)

(58) Field of Classification Search
CPC .... F24F 11/30; F24F 2110/10; F24F 11/0003; F25B 31/004; F04B 39/0207
See application file for complete search history.

(56) References Cited

U.S. PATENT DOCUMENTS 5,605,058 A * 2/1997 Kurachi ..... F25B 31/004 62/193
11,280,527 B2 * 3/2022 Wang ..... F25B 41/20
(Continued)

FOREIGN PATENT DOCUMENTS

CN 1892154 A 1/2007
CN 101988717 A 3/2011
(Continued)

OTHER PUBLICATIONS

ISR for PCT/CN2018/114618.
First OA for CN application 201711106179.9.

*Primary Examiner* — Kun Kai Ma
(74) *Attorney, Agent, or Firm* — Kilpatrick Townsend & Stockton, LLP

(57) ABSTRACT

A multi-split system and a method and device for adjusting an oil volume of a compressor of a multi-split system. The adjusting method comprises the following steps: recycling oil back to an oil storage tank by controlling a switch unit to turn on and an oil volume adjusting unit to turn off; when a continuous time over which the oil storage tank recycles oil reaches a first pre-set time (t1), controlling the switch unit to turn off and controlling a multi-split system to perform a test run; obtaining, according to a low-pressure piping pressure loss (P1) and a refrigerant flow (Q), a low-pressure piping pipe diameter (D) and a low-pressure refrigerant density (Den), an excess oil volume (Q2) that needs to be recycled, and obtaining, according to the excess oil volume and a
(Continued)

maximum oil storage volume (Qz) of the oil storage tank, an oil volume to be expelled (Q3).

9 Claims, 4 Drawing Sheets

(51) Int. Cl.

| | |
|---|---|
| ***F24F 1/0003*** | (2019.01) |
| ***F24F 11/30*** | (2018.01) |
| ***F24F 110/10*** | (2018.01) |
| ***F25B 31/00*** | (2006.01) |

(52) U.S. Cl.
CPC ..... *F24F 11/30* (2018.01); *F24F 2110/10* (2018.01); *F25B 31/004* (2013.01)

(56) References Cited

U.S. PATENT DOCUMENTS

| | | | | |
|---|---|---|---|---|
| 2009/0133435 | A1* | 5/2009 | Toyoshima | F25B 43/006 62/473 |
| 2009/0320507 | A1* | 12/2009 | Saruwatari | F25B 49/005 62/234 |
| 2011/0097216 | A1 | 4/2011 | Kuzdzal | |

FOREIGN PATENT DOCUMENTS

| | | | |
|---|---|---|---|
| CN | 103471298 | A | 12/2013 |
| CN | 203657079 | U | 6/2014 |
| CN | 104180563 | A | 12/2014 |
| CN | 105352064 | A | 2/2016 |
| CN | 107939649 | A | 4/2018 |
| JP | H07247961 | A | 9/1995 |

* cited by examiner

MULTI-SPLIT SYSTEM AND METHOD AND APPARATUS FOR ADJUSTING OIL VOLUME OF COMPRESSOR OF MULTI-SPLIT SYSTEM

CROSS-REFERENCE TO RELATED APPLICATION

This application is a national stage of International Application No. PCT/CN2018/114618, filed on Nov. 8, 2018, which claims priority to and benefits of Chinese Patent Application Serial No. 201711106179.9, filed with the National Intellectual Property Office Administration of P. R. China on Nov. 10, 2017, the entire content of which is incorporated herein by reference.

FIELD

The present disclosure relates to a field of air conditioners, and more particularly to a method for adjusting an oil volume of a compressor of a multi-split system, an apparatus for adjusting an oil volume of a compressor of a multi-split system and a multi-split system including such an apparatus.

BACKGROUND

A compressor of a multi-split system requires sufficient lubricating oil for lubrication. If the oil amount of the compressor is insufficient, the lubrication is insufficient and a problem of power increase of the compressor and abrasion of moving components of the compressor may cause the compressor to burn. During installation, when the multi-split system requires a longer piping or a larger indoor unit ratio, the lubricating oil in the piping and the indoor units of such a multi-split system may be increased compared to a short-piping multi-split system. In order to ensure that there is sufficient lubricating oil in the compressor, the system needs to be filled with more refrigeration oil. If additional lubricating oil is added during installation of the multi-split system, problems caused by such as water ingress, mixed lubricating oil and improper charging amount may occur. On this basis, it is required to add a maximum amount of lubricating oil according to an installation range design of a product during the product design. However, in this case, when the installation of the system only requires a short piping, redundant lubricating oil will enter a heat exchanger and a refrigerant connection pipe of the system, resulting in a decrease in heat exchange performance of the heat exchanger and an increase in pressure loss of the refrigerant connection pipe, which seriously affects operating efficiency of the system.

SUMMARY

The present disclosure seeks to solve at least one of the problems that exist in the related art to at least some extent. Accordingly, one embodiment of the present disclosure is to provide a method for adjusting an oil volume of a compressor of a multi-split system. With such a method, a problem of an energy efficiency loss of the system caused by overfilled compressor oil can be effectively solved, thus improving the operating efficiency of the system.

One embodiment of the present disclosure is to provide a non-transitory computer-readable storage medium.

One embodiment of the present disclosure is to provide an apparatus for adjusting an oil volume of a compressor of a multi-split system.

One embodiment of the present disclosure is to provide a multi-split system.

Embodiments of the present disclosure provides in embodiments a method for adjusting an oil volume of a compressor of a multi-split system, the multi-split system includes an outdoor unit and a plurality of indoor units, the outdoor unit includes a compressor, an oil separator, an outdoor heat exchanger, an outdoor throttle valve, and an oil volume adjusting device, the oil volume adjusting device and the oil separator are connected in parallel, a first end of the oil volume adjusting device is connected to an gas outlet of the compressor, a second end of the oil volume adjusting device is connected to the outdoor heat exchanger via a four-way valve, a third end of the oil volume adjusting device is connected to a gas return port of the compressor, the oil volume adjusting device includes a switch unit, an oil storage tank and an oil volume adjusting unit, and the method includes: controlling the switch unit to turn on and controlling the oil volume adjusting unit to turn off to enable the oil storage tank to recover oil; controlling the switch unit to turn off and controlling the multi-split system to perform a test run after a duration in which the oil is recovered to the oil storage tank reaches a first preset duration; acquiring a pressure loss of a low-pressure piping and a refrigerant flow quantity during the test run of the multi-split system, and acquiring a pipe diameter of the low-pressure piping and a density of a low-pressure refrigerant in the multi-split system; acquiring a redundant oil volume to be recovered according to the pressure loss of the low-pressure piping, the refrigerant flow quantity, the pipe diameter of the low-pressure piping and the density of the low-pressure refrigerant, and acquiring an oil volume to be discharged according to the redundant oil volume and a maximum oil storage volume of the oil storage tank; controlling a difference between a high pressure and a low pressure of the multi-split system to be in a preset pressure range to acquire an oil discharging rate, acquiring an oil discharging duration according to the oil volume to be discharged and the oil discharging rate, and controlling a turn-on duration of the oil volume adjusting device to reach the oil discharging duration to discharge the oil volume to be discharged out of the multi-split system.

With such a method for adjusting the oil volume of the compressor of the multi-split system provided in embodiments of the present disclosure, the switch unit is controlled to turn on and the oil volume adjusting unit is controlled to turn off to enable the oil storage tank to recover oil, and after the duration in which the oil is recovered to the oil storage tank reaches the first preset duration, the switch unit is controlled to turn off and the multi-split system is controlled to perform the test run. Then, the pressure loss of the low-pressure piping and the refrigerant flow quantity during the test run of the multi-split system are acquired, the pipe diameter of the low-pressure piping and the density of the low-pressure refrigerant in the multi-split system are acquired, the redundant oil volume to be recovered is acquired according to the pressure loss of the low-pressure piping, the refrigerant flow quantity, the pipe diameter of the low-pressure piping and the density of the low-pressure refrigerant, and the oil volume to be discharged is acquired according to the redundant oil volume and the maximum oil storage volume of the oil storage tank. At last, the difference between the high pressure and the low pressure of the multi-split system is controlled to be in the preset pressure range to acquire the oil discharging rate, the oil discharging duration is acquired according to the oil volume to be discharged and the oil discharging rate, and the turn-on duration of the oil volume adjusting device is controlled to reach the oil discharging duration to discharge the oil volume to be discharged out of the multi-split system. Therefore, with such a method, the problem of the energy efficiency loss of the system caused by the over-filled compressor oil can be effectively solved, thus improving the operating efficiency of the system.

In addition, the method for adjusting the oil volume of the compressor of the multi-split system provided in the above embodiments may further include following additional features.

In an embodiment of the present disclosure, acquiring the redundant oil volume to be recovered according to the pressure loss of the low-pressure piping, the refrigerant flow quantity, the pipe diameter of the low-pressure piping and the density of the low-pressure refrigerant includes: acquiring an oil volume required by a current piping of the multi-split system according to the pressure loss of the low-pressure piping, the refrigerant flow quantity, the pipe diameter of the low-pressure piping and the density of the low-pressure refrigerant; acquiring an additional-supplemented oil volume of the multi-split system; subtracting the oil volume required by the current piping from the additional-supplemented oil volume to acquire the redundant oil volume.

In an embodiment of the present disclosure, the oil discharging duration is acquired according to the formula: $t2=B*Q3/Qx$, where t2 is the oil discharging duration, B is a preset coefficient, Qx is the oil discharging rate, Q3 is the oil volume to be discharged, and $Q3=Q2-Qz$, where Q2 is the redundant oil volume, and Qz is the maximum oil storage volume of the oil storage tank.

In an embodiment of the present disclosure, a first end of the oil separator is connected to the gas outlet of the compressor, a second end of the oil separator is connected to the second end of the oil volume adjusting device, and a third end of the oil separator is connected to the gas return port of the compressor via a first capillary tube and a first electromagnetic valve, respectively, the oil volume adjusting unit includes a second capillary tube and a second electromagnetic valve in series, and the second capillary tube and the second electromagnetic valve in series are disposed between the gas return port of the compressor and the adjustment port of the oil storage tank, the switch unit includes a third electromagnetic valve disposed between the gas outlet of the compressor and an inlet of the oil storage tank, and a refrigerant outlet of the oil storage tank is connected to the outdoor heat exchanger via the four-way valve.

Embodiments the present disclosure provide a non-transitory computer-readable storage medium having stored therein computer programs that, when executed by a processor, cause the processor to perform a method for adjusting an oil volume of a compressor of a multi-split system as described above.

With such a non-transitory computer-readable storage medium provided in the embodiments of the present disclosure, by performing the method for adjusting the oil volume of the compressor of the multi-split system as described above, the problem of the energy efficiency loss of the system caused by the over-filled compressor oil can be effectively solved, thus improving the operating efficiency of the system.

In one embodiment the present disclosure provides an apparatus for adjusting an oil volume of a compressor of a multi-split system. The multi-split system includes an outdoor unit and a plurality of indoor units, the outdoor unit includes a compressor, an oil separator, an outdoor heat exchanger, an outdoor throttle valve, and an oil volume adjusting device, the oil volume adjusting device and the oil separator are connected in parallel, a first end of the oil volume adjusting device is connected to an gas outlet of the compressor, a second end of the oil volume adjusting device is connected to the outdoor heat exchanger via a four-way valve, a third end of the oil volume adjusting device is connected to a gas return port of the compressor, the oil volume adjusting device includes a switch unit, an oil storage tank and an oil volume adjusting unit, and the apparatus includes: a controlling device configured to control the switch unit to turn on and control the oil volume adjusting unit to turn off to enable the oil storage tank to recover oil, and control the switch unit to turn off and control the multi-split system to perform a test run after a duration in which oil is recovered to the oil storage tank reaches a first preset duration; an acquiring device configured to acquire a pressure loss of a low-pressure piping and a refrigerant flow quantity during the test run of the multi-split system, and acquire a pipe diameter of the low-pressure piping and a density of a low-pressure refrigerant in the multi-split system; a calculating device configured to acquire a redundant oil volume to be recovered according to the pressure loss of the low-pressure piping, the refrigerant flow quantity, the pipe diameter of the low-pressure piping and the density of the low-pressure refrigerant, and acquire an oil volume to be discharged according to the redundant oil volume and a maximum oil storage volume of the oil storage tank; in which the controlling device is further configured to control a difference between a high pressure and a low pressure of the multi-split system to be in a preset pressure range to acquire an oil discharging rate, acquire an oil discharging duration according to the oil volume to be discharged and the oil discharging rate, and control a turn-on duration of the oil volume adjusting device to reach the oil discharging duration to discharge the oil volume to be discharged out of the multi-split system.

With such an apparatus for adjusting the oil volume of the compressor of the multi-split system provided in embodiments of the present disclosure, the controlling device controls the switch unit to turn on and controls the oil volume adjusting unit to turn off to enable the oil storage tank to recover oil, and controls the switch unit to turn off and controls the multi-split system to perform the test run after the duration in which oil is recovered to the oil storage tank reaches the first preset duration. The acquiring device acquires the pressure loss of the low-pressure piping and the refrigerant flow quantity during the test run of the multi-split system, and acquires the pipe diameter of the low-pressure piping and the density of the low-pressure refrigerant in the multi-split system. The calculating device acquires the redundant oil volume to be recovered according to the pressure loss of the low-pressure piping, the refrigerant flow quantity, the pipe diameter of the low-pressure piping and the density of the low-pressure refrigerant, and acquires the oil volume to be discharged according to the redundant oil volume and the maximum oil storage volume of the oil storage tank. Further, the controlling device controls the difference between the high pressure and the low pressure of the multi-split system to be in the preset pressure range to acquire an oil discharging rate, acquires the oil discharging duration according to the oil volume to be discharged and the oil discharging rate, and controls the turn-on duration of the oil volume adjusting device to reach the oil discharging duration to discharge the oil volume to be discharged out of the multi-split system. Therefore, with such an apparatus, the problem of the energy efficiency loss of the system caused by the over-filled compressor oil can be effectively solved, thus improving the operating efficiency of the system.

In addition, the apparatus for adjusting the oil volume of the compressor of the multi-split system provided in the above embodiments may further include following additional features.

In an embodiment of the present disclosure, the calculating device is further configured to: acquire an oil volume required by a current piping of the multi-split system according to the pressure loss of the low-pressure piping, the refrigerant flow quantity, the pipe diameter of the low-pressure piping and the density of the low-pressure refrigerant; acquire an additional-supplemented oil volume of the multi-split system; subtract the oil volume required by the current piping from the additional-supplemented oil volume to acquire the redundant oil volume.

In an embodiment of the present disclosure, the controlling device acquires the oil discharging duration according to the following formula: $t2=B*Q3/Qx$, where t2 is the oil discharging duration, B is a preset coefficient, Qx is the oil discharging rate, Q3 is the oil volume to be discharged, and $Q3=Q2-Qz$, where Q2 is the redundant oil volume, and Qz is the maximum oil storage volume of the oil storage tank.

In an embodiment of the present disclosure, a first end of the oil separator is connected to the gas outlet of the compressor, a second end of the oil separator is connected to the second end of the oil volume adjusting device, and a third end of the oil separator is connected to the gas return port of the compressor via a first capillary tube and a first electromagnetic valve, respectively, the oil volume adjusting unit includes a second capillary tube and a second electromagnetic valve in series, and the second capillary tube and the second electromagnetic valve in series are disposed between the gas return port of the compressor and the adjustment port of the oil storage tank, the switch unit includes a third electromagnetic valve disposed between the gas outlet of the compressor and an inlet of the oil storage tank, and a refrigerant outlet of the oil storage tank is connected to the outdoor heat exchanger via the four-way valve.

One embodiment of the present disclosure provides a multi-split system, including an apparatus for adjusting an oil volume of a compressor of a multi-split system as described above.

In the multi-split system provided in the embodiments of the present disclosure, the apparatus for adjusting the oil volume of the compressor of the multi-split system as described above is included, so that the problem of the energy efficiency loss of the system caused by the over-filled compressor oil can be effectively solved, thus improving the operating efficiency of the system.

Figure 1:
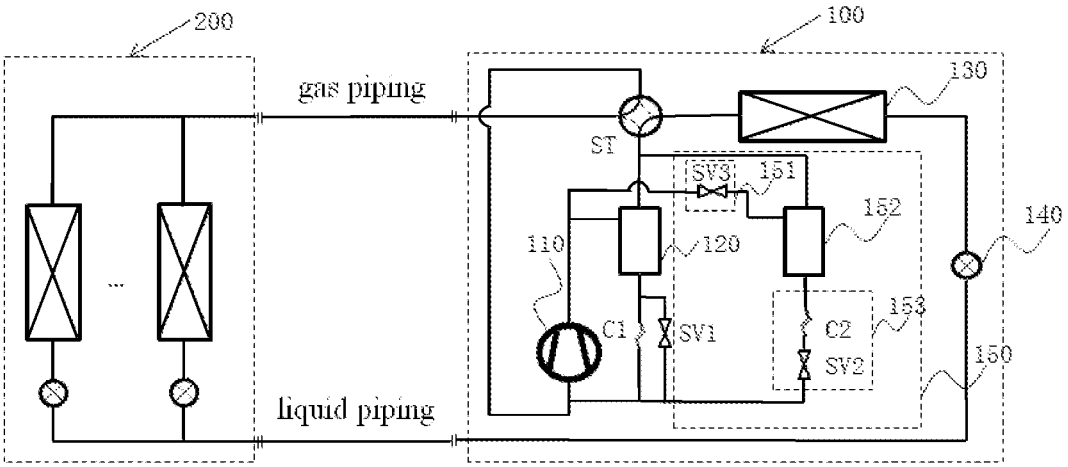
FIG. 1 is a schematic diagram of a multi-split system according to an embodiment of the present disclosure.

REFERENCE NUMERALS outdoor unit 100, a plurality of indoor units 200, compressor 110, oil separator 120, outdoor heat exchanger 130, outdoor throttle valve 140, oil volume adjusting device 150, switch unit 151, oil storage tank 152, oil volume adjusting unit 153, first capillary tube C1, first electromagnetic valve SV1, second capillary tube C2, second electromagnetic valve SV2, third electromagnetic valve SV3, and four-way valve ST.

DETAILED DESCRIPTION

Embodiments of the present disclosure are described in detail below, examples of which are illustrated in the drawings. The same or similar elements are denoted by same reference numerals in different drawings unless indicated otherwise. The embodiments described herein with reference to drawings are explanatory, and used to generally understand the present disclosure. The embodiments shall not be construed to limit the present disclosure.

Method and apparatus for adjusting an oil volume of a compressor of a multi-split system, and a multi-split system having such an apparatus according to embodiments of the present disclosure are described below with reference to the drawings.

Figure 2:
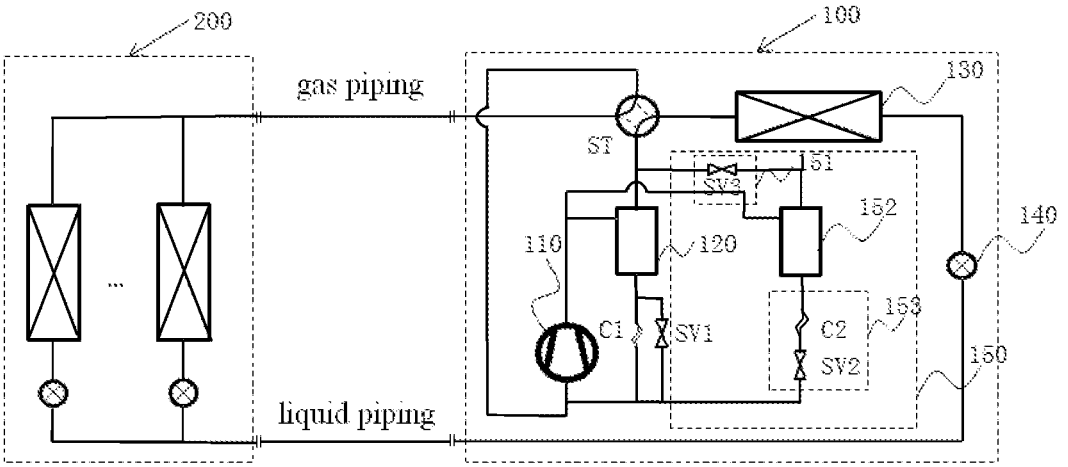
FIG. 2 is a schematic diagram of a multi-split system according to another embodiment of the present disclosure.

In embodiments of the present disclosure, as shown in FIG. 1 and FIG. 2, the multi-split system may include an outdoor unit 100 and a plurality of indoor units 200. The outdoor unit 100 includes a compressor 110, an oil separator 120, an outdoor heat exchanger 130, an outdoor throttle valve 140, and an oil volume adjusting device 150. The oil volume adjusting device 150 and the oil separator 120 are connected in parallel. A first end of the oil volume adjusting device 150 is connected to an gas outlet of the compressor 110, a second end of the oil volume adjusting device 150 is connected to the outdoor heat exchanger 130 via a four-way valve ST, a third end of the oil volume adjusting device 150 is connected to a gas return port of the compressor 110. The oil volume adjusting device 150 includes a switch unit 151, an oil storage tank 152 and an oil volume adjusting unit 153. In one embodiment, the oil volume adjusting device 150 is configured to recovery lubricating oil functioning in the multi-split system and to control the oil volume adjusting unit 153, to fill the oil storage tank 152 with the lubricating oil.

Further, in an embodiment of the present disclosure, as shown in FIG. 1, a first end of the oil separator 120 is connected to the gas outlet of the compressor 110, a second end of the oil separator 120 is connected to the second end of the oil volume adjusting device 150, and a third end of the oil separator 120 is connected to the gas return port of the compressor 110 via a first capillary tube C1 and a first electromagnetic valve SV1, respectively. The oil volume adjusting unit 153 may include a second capillary tube C2 and a second electromagnetic valve SV2 in series, and the second capillary tube C2 and the second electromagnetic valve SV2 in series are disposed between the gas return port of the compressor 110 and the adjustment port of the oil storage tank 152. The switch unit 151 includes a third electromagnetic valve SV3 disposed between the gas outlet of the compressor 110 and an inlet of the oil storage tank 152, and a refrigerant outlet of the oil storage tank 152 is connected to the outdoor heat exchanger 130 via the four-way valve ST.

In one embodiment, as shown in FIG. 1, the oil volume adjusting device 150 and the oil separator 120 are connected in parallel. The first end of the oil volume adjusting device 150 is connected to the gas outlet of the compressor 110, the second end of the oil volume adjusting device 150 is connected to an inlet of the four-way valve ST, the third end of the oil volume adjusting device 150 is connected to the gas return port of the compressor 110 via the capillary tube. The oil volume adjusting device 150 includes the oil storage tank 152, the switch unit 151, the oil volume detecting unit (not specifically shown in the drawings) and the oil volume adjusting unit 153. In one embodiment, the oil storage tank 152 can perform oil separation on exhaust from the compressor 110, and the switch unit 151 may be provided at an inlet (as shown in FIG. 1) or an outlet (as shown in FIG. 2) of the oil storage tank 152 to control the refrigerant to pass through the oil storage tank 152 or not. The oil volume adjusting unit 153 is provided at a pipe connecting the oil storage tank 152 with a low-pressure pipe of the system, and is configured to adjust the oil volume in the oil storage tank 152. The oil volume adjusting unit 153 may be constituted by an electromagnetic valve, by an electromagnetic valve and a capillary tube in series, or by an electronic expansion valve.

It should be noted that there may be one or more oil storage tanks 152, and the oil volume adjusting unit 153 may be constituted by the electromagnetic valve, by the electromagnetic valve and the capillary tube in series, or by the electronic expansion valve. The switch unit 151 may be provided at the inlet or the outlet of the oil storage tank 152. The schematic diagram shown in FIG. 1 or FIG. 2 is only one embodiment of the present disclosure.

Figure 3:
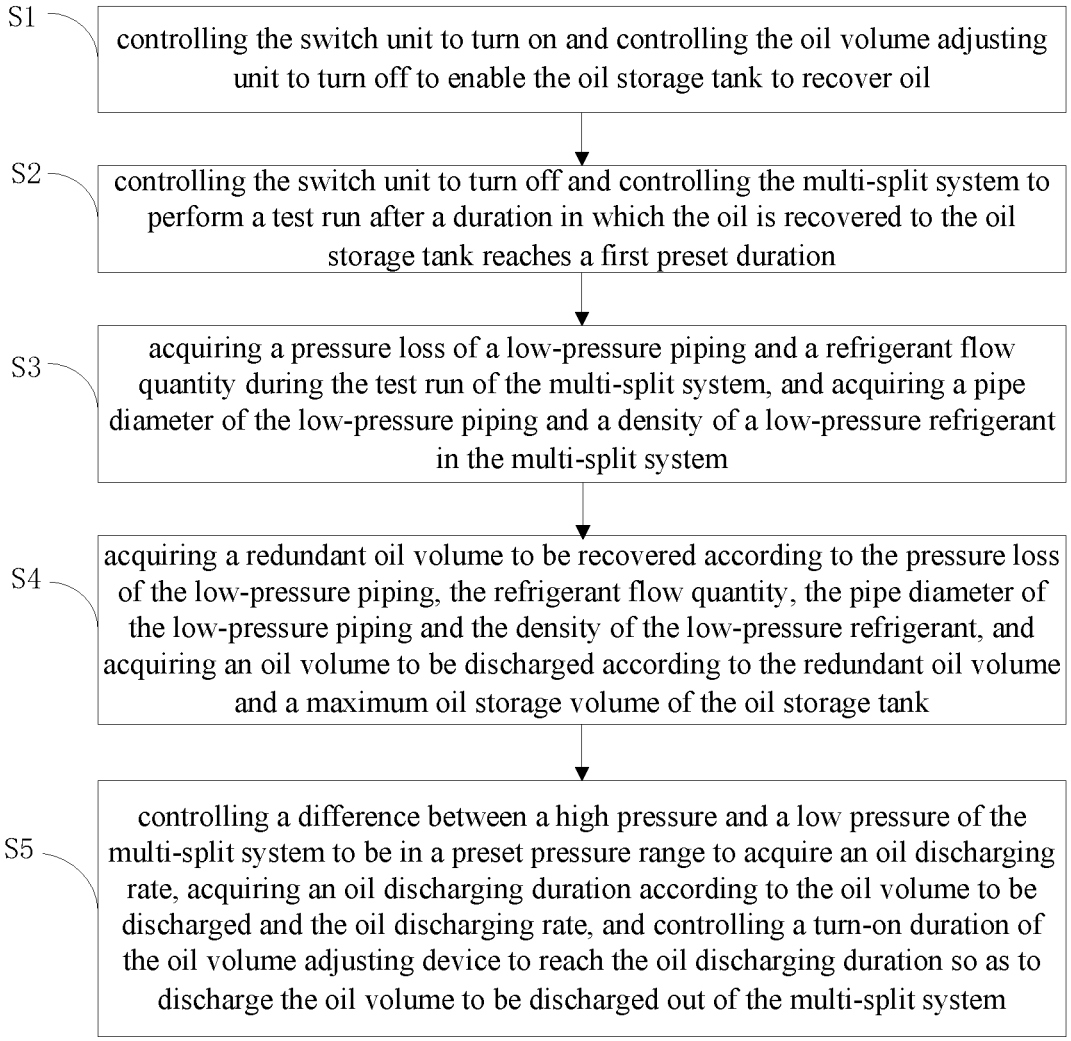
FIG. 3 is a flow chart of a method for adjusting an oil volume of a compressor of a multi-split system according to an embodiment of the present disclosure.

FIG. 3 is a flow chart of a method for adjusting an oil volume of a compressor of a multi-split system according to an embodiment of the present disclosure.

As shown in FIG. 3, the method for adjusting the oil volume of the compressor of the multi-split system according to an embodiment of the present disclosure may include following steps.

In S1, the switch unit is controlled to turn on and the oil volume adjusting unit is controlled to turn off to enable the oil storage tank to recover oil.

In one embodiment, during operation, the switch unit at the inlet of the oil storage tank is in the turn-off state, and at the same time, the oil volume adjusting unit is also in the turn-off state. When the oil is recovered to the oil storage tank, the switch unit at the inlet of the oil storage tank is in the turn-on state, and the oil volume adjusting unit is still in the turn-off state at the same time.

In S2, after a duration in which the oil is recovered to the oil storage tank reaches a first preset duration, the switch unit is controlled to turn off and the multi-split system is controlled to perform a test run. In one embodiment, the first preset duration is long enough to fully fill the oil storage tank, which can be calibrated according to actual conditions.

In other words, after the oil storage tank is recovering oil for the first preset duration t1, the switch unit is turned off, the oil storage tank is full of oil, and the multi-line system is tested for a trial operation. The compressor is working at a preset frequency, and the indoor unit is working in a preset state.

In S3, a pressure loss of a low-pressure piping and a refrigerant flow quantity during the test run of the multi-split system are acquired, and a pipe diameter of the low-pressure piping and a density of a low-pressure refrigerant in the multi-split system are acquired.

In one embodiment, the pressure loss P1 of the low-pressure piping is acquired from a pressure difference between a pressure at an inlet of an indoor heat exchanger and a gas return pressure of the compressor.

The refrigerant flow quantity may be acquired from calculation based on a ten-coefficient equation of the compressor, i.e., $Q=A0+A1*Tev+A2*Tcd+A3*Tev2+A4*Tev*Tcd+A5*Tcd^2+A6*Tev^3+A7*Tcd*Tev^2+A8*Tev*Tcd^2+A9*Tcd^3$, where A0 to A9 are experimentally-fitted constant values, Tev is a low-pressure saturation temperature, and Tcd is a high-pressure saturation temperature.

The diameter D of the low-pressure piping of the multi-split system may be acquried according to an outdoor unit model table. The density Den of the low-pressure refrigerant may be determined according to refrigerant type, and pressure and temperature at the low-pressure side.

In S4, a redundant oil volume to be recovered is acquired according to the pressure loss of the low-pressure piping, the refrigerant flow quantity, the pipe diameter of the low-pressure piping and the density of the low-pressure refrigerant, and an oil volume to be discharged is acquired according to the redundant oil volume and a maximum oil storage volume of the oil storage tank.

In an embodiment of the present disclosure, acquisition of the redundant oil volume to be recovered according to the pressure loss of the low-pressure piping, the refrigerant flow quantity, the pipe diameter of the low-pressure piping and the density of the low-pressure refrigerant includes: acquiring an oil volume required by a current piping of the multi-split system according to the pressure loss of the low-pressure piping, the refrigerant flow quantity, the pipe diameter of the low-pressure piping and the density of the low-pressure refrigerant; acquiring an additional-supplemented oil volume of the multi-split system; subtracting the oil volume required by the current piping from the additional-supplemented oil volume to acquire the redundant oil volume.

In one embodiment, according to the pressure loss P1 of the low-pressure piping when the current system is working, the refrigerant flow quantity Q when the current system is working, the pipe diameter D of the low-pressure piping and the density Den of the low-pressure refrigerant of the current system, an equivalent piping length L of the system may be acquired as $L=A*D5*P1*Den/Q2$, where A is a experimentally-fitted constant value. Then, according to the calculated equivalent piping length and high and low pressure piping diameters queried from the table, the oil volume Q1 required for the current length of piping may be acquried (by looking up the pre-set table). Finally, the redundant oil volume Q2 to be recovered may be calculated according to the formula $Q2=Qe-Q1$, where Qe is the additional-supplemented oil volume when the system is designed.

In S5, a difference between a high pressure and a low pressure of the multi-split system is controlled to be in a pre-set pressure range to acquire an oil discharging rate, an oil discharging duration is acquired according to the oil volume to be discharged and the oil discharging rate, and a turn-on duration of the oil volume adjusting device is controlled to reach the oil discharging duration to discharge the oil volume to be discharged out of the multi-split system.

In an embodiment of the present disclosure, the oil discharging duration is acquired according to the following formula: $t2=B*Q3/Qx$, where t2 is the oil discharging duration, B is a pre-set coefficient, Qx is the oil discharging rate, Q3 is the oil volume to be discharged, and Q3=Q2−Qz, where Q2 is the redundant oil volume, and Qz is the maximum oil storage volume of the oil storage tank.

In one embodiment, after acquiring the redundant oil quantity Q2 to be recovered by the calculation according to the formula Q3=Q2−Qz, the oil volume Q3 to be discharged from the oil storage tank, which is full of oil, is further calculated. The multi-split system enters an oil discharge control operation state, and the oil discharge control is as follows: the switch unit maintains in the turn-off state, and the difference between the high pressure and the low pressure of the multi-split system is controlled in the pre-set pressure range to ensure the oil volume Qx recovered per unit duration (i.e, the oil discharging rate) when the oil volume adjusting unit is turned on; according to the formula t2=B*Q3/Qx, the oil discharging duration t2 is calculated; the oil volume adjusting unit is turned on to discharge the oil volume to be discharged out of the multi-split system, and after working for the duration t2, the oil volume adjusting unit is turned off and the system retreats from the oil discharge control. Therefore, the problem of an energy efficiency loss of the system caused by over-filled compressor oil can be effectively solved, thus improving the operating efficiency of the system.

As described above, by adding an oil volume adjusting device to the multi-split system, the oil volume functioning in the system can be controlled according to the installation characteristics of the system, to improve the operating efficiency of the system.

Figure 4:
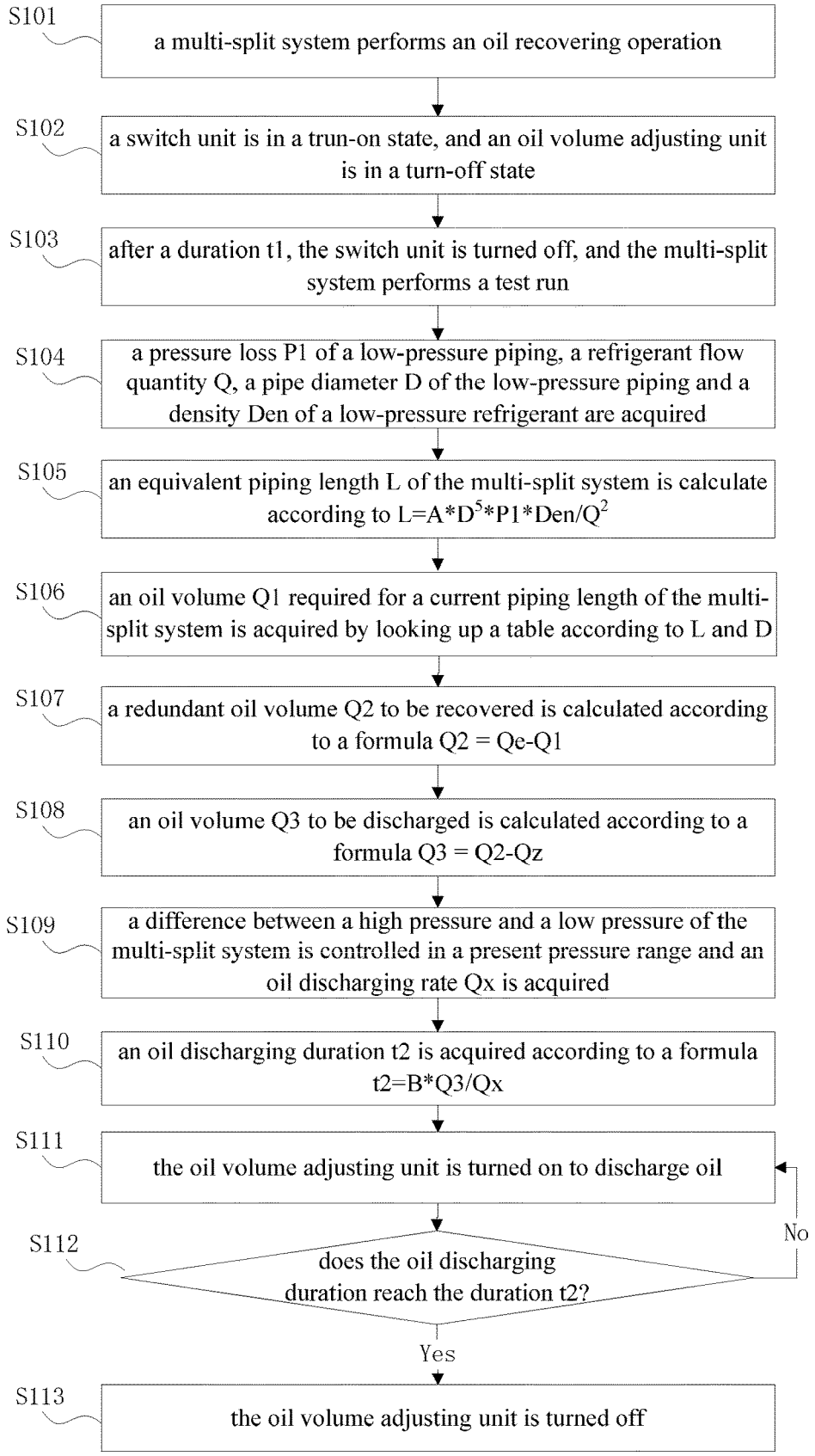
FIG. 4 is a flow chart of a method for adjusting an oil volume of a compressor of a multi-split system according to another embodiment of the present disclosure.

For better understanding of the present disclosure, FIG. 4 is a flow chart of a method for adjusting an oil volume of a compressor of a multi-split system according to another embodiment of the present disclosure. As shown in FIG. 4, the method for adjusting the oil volume of the compressor of the multi-split system may include the following steps.

In S101, a multi-split system performs an oil recovering operation.

In S102, a switch unit is in a turn-on state, and an oil volume adjusting unit is in a turn-off state.

In S103, after a first pre-set duration t1, the switch unit is turned off, and the multi-split system performs a test run.

In S104, a pressure loss P1 of a low-pressure piping, a refrigerant flow quantity Q, a pipe diameter D of the low-pressure piping and a density Den of a low-pressure refrigerant during the test run of the multi-split system are acquired.

In S105, an equivalent piping length L of the multi-split system is calculate according to a formula L=A*D5*P1*Den/Q2.

In S106, an oil volume Q1 required for a current piping length of the multi-split system is acquired by looking up a table according to L and D.

In S107, a redundant oil volume Q2 to be recovered is calculated according to a formula Q2=Qe−Q1, where Qe is an additional-supplemented oil volume when the system is designed.

In S108, an oil volume Q3 to be discharged is calculated according to a formula Q3=Q2−Qz, where Qz is a maximum oil storage volume of the oil storage tank.

In S109, a difference between a high pressure and a low pressure of the multi-split system is controlled in a present pressure range and an oil discharging rate Qx is acquired.

In S110, an oil discharging duration t2 is acquired according to a formula t2=B*Q3/Qx, where B is a pre-set coefficient.

In S111, the oil volume adjusting unit is turned on to discharge oil.

In S112, it is determined whether the oil discharging duration reaches the duration t2. If yes, S113 is performed; if no, it is back to S111.

In S113, the oil volume adjusting unit is turned off.

In conclusion, with such a method for adjusting the oil volume of the compressor of the multi-split system provided in embodiments of the present disclosure, the switch unit is controlled to turn on and the oil volume adjusting unit is controlled to turn off to enable the oil storage tank to recover oil, and after the duration in which the oil is recovered to the oil storage tank reaches the first pre-set duration, the switch unit is controlled to turn off and the multi-split system is controlled to perform the test run. Then, the pressure loss of the low-pressure piping and the refrigerant flow quantity during the test run of the multi-split system are acquired, the pipe diameter of the low-pressure piping and the density of the low-pressure refrigerant in the multi-split system are acquired, the redundant oil volume to be recovered is acquired according to the pressure loss of the low-pressure piping, the refrigerant flow quantity, the pipe diameter of the low-pressure piping and the density of the low-pressure refrigerant, and the oil volume to be discharged is acquired according to the redundant oil volume and the maximum oil storage volume of the oil storage tank. At last, the difference between the high pressure and the low pressure of the multi-split system is controlled to be in the pre-set pressure range to acquire the oil discharging rate, the oil discharging duration is acquired according to the oil volume to be discharged and the oil discharging rate, and the turn-on duration of the oil volume adjusting device is controlled to reach the oil discharging duration to discharge the oil volume to be discharged out of the multi-split system. Therefore, with such a method, the problem of the energy efficiency loss of the system caused by the over-filled compressor oil can be effectively solved, thus improving the operating efficiency of the system.

Figure 5:
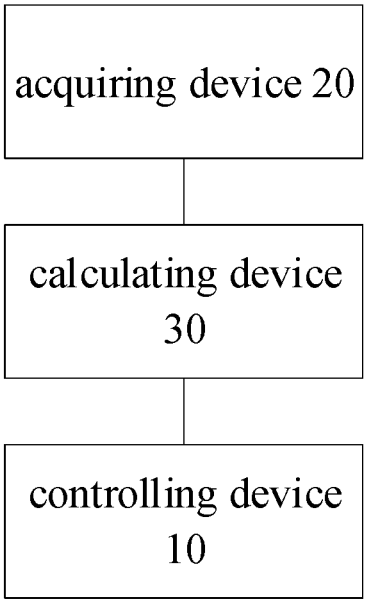
FIG. 5 is a block diagram of an apparatus for adjusting an oil volume of a compressor of a multi-split system according to an embodiment of the present disclosure.

FIG. 5 is a block diagram of an apparatus for adjusting an oil volume of a compressor of a multi-split system according to an embodiment of the present disclosure.

In embodiments of the present disclosure, as shown in FIG. 1 and FIG. 2, the multi-split system may include an outdoor unit 100 and a plurality of indoor units 200. The outdoor unit 100 includes a compressor 110, an oil separator 120, an outdoor heat exchanger 130, an outdoor throttle valve 140, and an oil volume adjusting device 150. The oil volume adjusting device 150 and the oil separator 120 are connected in parallel. A first end of the oil volume adjusting device 150 is connected to an gas outlet of the compressor 110, a second end of the oil volume adjusting device 150 is connected to the outdoor heat exchanger 130 via a four-way valve ST, a third end of the oil volume adjusting device 150 is connected to a gas return port of the compressor 110. The oil volume adjusting device 150 includes a switch unit 151, an oil storage tank 152 and an oil volume adjusting unit 153.

As shown in FIG. 5, the apparatus for adjusting the oil volume of the compressor of the multi-split system may include a controlling device 10, an acquiring device 20 and a calculating device 30.

In one embodiment, the controlling device 10 is configured to control the switch unit 151 to turn on and control the oil volume adjusting unit 153 to turn off to enable the oil storage tank to recover oil, and control the switch unit 151 to turn off and control the multi-split system to perform a test run after a duration in which oil is recovered to the oil storage tank reaches a first pre-set duration. The acquiring device 20 is configured to acquire a pressure loss of a low-pressure piping and a refrigerant flow quantity during the test run of the multi-split system, and acquire a pipe diameter of the low-pressure piping and a density of a low-pressure refrigerant in the multi-split system. The calculating device 30 is configured to acquire a redundant oil volume to be recovered according to the pressure loss of the low-pressure piping, the refrigerant flow quantity, the pipe diameter of the low-pressure piping and the density of the low-pressure refrigerant, and acquire an oil volume to be discharged according to the redundant oil volume and a maximum oil storage volume of the oil storage tank 152. The controlling device 10 is further configured to control a difference between a high pressure and a low pressure of the multi-split system to be in a pre-set pressure range to acquire an oil discharging rate, acquire an oil discharging duration according to the oil volume to be discharged and the oil discharging rate, and control a turn-on duration of the oil volume adjusting device 150 to reach the oil discharging duration to discharge the oil volume to be discharged out of the multi-split system.

In an embodiment of the present disclosure, the calculating device 30 is further configured to: acquire an oil volume required by a current piping of the multi-split system according to the pressure loss of the low-pressure piping, the refrigerant flow quantity, the pipe diameter of the low-pressure piping and the density of the low-pressure refrigerant; acquire an additional-supplemented oil volume of the multi-split system; subtract the oil volume required by the current piping from the additional-supplemented oil volume to acquire the redundant oil volume.

In an embodiment of the present disclosure, the controlling device 10 acquires the oil discharging duration according to the following formula: $t2=B*Q3/Qx$, where t2 is the oil discharging duration, B is a pre-set coefficient, Qx is the oil discharging rate, Q3 is the oil volume to be discharged, and $Q3=Q2-Qz$, where Q2 is the redundant oil volume, and Qz is the maximum oil storage volume of the oil storage tank.

In an embodiment of the present disclosure, as shown in FIG. 1, a first end of the oil separator 120 is connected to the gas outlet of the compressor 110, a second end of the oil separator 120 is connected to the second end of the oil volume adjusting device 150, and a third end of the oil separator 120 is connected to the gas return port of the compressor 110 via a first capillary tube C1 and a first electromagnetic valve SV1, respectively. The oil volume adjusting unit 153 may include a second capillary tube C2 and a second electromagnetic valve SV2 in series, and the second capillary tube C2 and the second electromagnetic valve SV2 in series are disposed between the gas return port of the compressor 110 and the adjustment port of the oil storage tank 152. The switch unit 151 includes a third electromagnetic valve SV3 disposed between the gas outlet of the compressor 110 and an inlet of the oil storage tank 152, and a refrigerant outlet of the oil storage tank 152 is connected to the outdoor heat exchanger 130 via the four-way valve ST.

It should be noted that details disclosed in the embodiments of the present method for adjusting the oil volume of the compressor of the multi-split system are also applicable to the apparatus for adjusting the oil volume of the compressor of the multi-split system of the present disclosure, which will not be elaborated in detail herein.

With such an apparatus for adjusting the oil volume of the compressor of the multi-split system provided in embodiments of the present disclosure, the controlling device controls the switch unit to turn on and controls the oil volume adjusting unit to turn off to enable the oil storage tank to recover oil, and controls the switch unit to turn off and controls the multi-split system to perform the test run after the duration in which oil is recovered to the oil storage tank reaches the first pre-set duration. The acquiring device acquires the pressure loss of the low-pressure piping and the refrigerant flow quantity during the test run of the multi-split system, and acquires the pipe diameter of the low-pressure piping and the density of the low-pressure refrigerant in the multi-split system. The calculating device acquires the redundant oil volume to be recovered according to the pressure loss of the low-pressure piping, the refrigerant flow quantity, the pipe diameter of the low-pressure piping and the density of the low-pressure refrigerant, and acquires the oil volume to be discharged according to the redundant oil volume and the maximum oil storage volume of the oil storage tank. Further, the controlling device controls the difference between the high pressure and the low pressure of the multi-split system to be in the pre-set pressure range to acquire an oil discharging rate, acquires the oil discharging duration according to the oil volume to be discharged and the oil discharging rate, and controls the turn-on duration of the oil volume adjusting device to reach the oil discharging duration to discharge the oil volume to be discharged out of the multi-split system. Therefore, with such an apparatus, the problem of the energy efficiency loss of the system caused by the over-filled compressor oil can be effectively solved, thus improving the operating efficiency of the system.

In addition, the present disclosure provides in embodiments a non-transitory computer-readable storage medium having stored therein computer programs that, when executed by a processor, cause the processor to perform a method for adjusting an oil volume of a compressor of a multi-split system as described above.

With such a non-transitory computer-readable storage medium provided in the embodiments of the present disclosure, by performing the method for adjusting the oil volume of the compressor of the multi-split system as described above, the problem of the energy efficiency loss of the system caused by the over-filled compressor oil can be effectively solved, thus improving the operating efficiency of the system.

In addition, the present disclosure provides in embodiments a multi-split system, including an apparatus for adjusting an oil volume of a compressor of a multi-split system as described above.

In the multi-split system provided in the embodiments of the present disclosure, the apparatus for adjusting the oil volume of the compressor of the multi-split system as described above is included, so that the problem of the energy efficiency loss of the system caused by the over-filled compressor oil can be effectively solved, thus improving the operating efficiency of the system.

Reference throughout this specification to "an embodiment", "some embodiments", "an example", "a specific example", or "some examples" means that a particular feature, structure, material, or characteristic described in connection with the embodiment or example is included in at least one embodiment or example of the present disclosure. Thus, the appearances of above phrases in various places throughout this specification are not necessarily referring to the same embodiment or example of the present disclosure. Furthermore, the particular features, structures, materials, or characteristics may be combined in any suitable manner in one or more embodiments or examples. In addition, different embodiments or examples described in the specification, as well as features of embodiments or examples, without conflicting.

In addition, terms such as "first" and "second" are used herein for purposes of description and are not intended to indicate or imply relative importance or significance or to imply the number of indicated features. Thus, the feature defined with "first" and "second" may include one or more of this feature. In the description of the present disclosure, unless specified otherwise, "a plurality of" means two or more than two, for example two or three.

It will be understood that, the flow chart or any process or method described herein in other manners may represent a device, segment, or portion of code that includes one or more executable instructions to implement the specified logic function(s) or that includes one or more executable instructions of the steps of the progress, and the scope of an embodiment of the present disclosure includes other implementations. Although the flow chart shows a specific order of execution, it is understood that the order of execution may differ from that which is depicted. For example, the order of execution of two or more boxes may be scrambled relative to the order shown.

The logic and/or step described in other manners herein or shown in the flow chart, for example, a particular sequence table of executable instructions for realizing the logical function, may be specifically implemented in any computer readable medium to be used by the instruction execution system, device or equipment (such as the system based on computers, the system including processors or other systems configured to obtain the instruction from the instruction execution system, device and equipment and executing the instruction), or to be used in combination with the instruction execution system, device and equipment. As to the specification, "the computer readable medium" may be any device adaptive for including, storing, communicating, propagating or transferring programs to be used by or in combination with the instruction execution system, device or equipment. More specific examples of the computer readable medium include but are not limited to: an electronic connection (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium configured to print programs thereon, this is because, for example, the paper or other appropriate medium may be optically scanned and then edited, decrypted or processed with other appropriate methods when necessary to obtain the programs in an electric manner, and then the programs may be stored in the computer memories.

It should be understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

The programs may be stored in a computer readable storage medium, and the programs include one or a combination of the steps in the method embodiments of the present disclosure when run on a computer.

In addition, each function cell of the embodiments of the present disclosure may be integrated in a processing device, or these cells may be separate physical existence, or two or more cells are integrated in a processing device. The integrated device may be realized in a form of hardware or in a form of software function devices. When the integrated device is realized in a form of software function device and is sold or used as a standalone product, the integrated device may be stored in a computer readable storage medium.

The storage medium mentioned above may be read-only memories, magnetic disks, CD, etc. Although explanatory embodiments have been shown and described.

In the specification, it is to be understood that terms such as "central", "longitudinal", "lateral", "length", "width", "thickness", "upper", "lower", "front", "rear", "left", "right", "vertical", "horizontal", "top", "bottom", "inner", "outer", "clockwise", "counterclockwise", "axial", "radial" and "circumferential" should be construed to refer to the orientation as then described or as shown in the drawings under discussion. These relative terms are for convenience of description and do not require that the present disclosure be constructed or operated in a particular orientation, and thus shall not be construed to limit the present disclosure.

In the present disclosure, unless specified or limited otherwise, the terms "mounted", "connected", "coupled", "fixed" and the like are used broadly, and may be, for example, fixed connections, detachable connections, or integral connections; may also be mechanical or electrical connections; may also be direct connections or indirect connections via intervening structures; may also be inner communications of two elements.

In the description, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed there between. Furthermore, a first feature "on", "above" or "on top of" a second feature may include an embodiment in which the first feature is right or obliquely "on", "above" or "on top of" the second feature, or just means that the first feature is at a height higher than that of the second feature; while a first feature "below", "under" or "on bottom of" a second feature may include an embodiment in which the first feature is right or obliquely "below", "under" or "on bottom of" the second feature, or just means that the first feature is at a height lower than that of the second feature.

What is claimed is:

1. A method for adjusting an oil volume of a compressor of a multi-split system:

the multi-split system comprises an outdoor unit and a plurality of indoor units;

the outdoor unit comprises a compressor, an oil separator, an outdoor heat exchanger, an outdoor throttle valve, and an oil volume adjusting device;

the oil volume adjusting device and the oil separator are connected in parallel;

a first end of the oil volume adjusting device is connected to an gas outlet of the compressor, a second end of the oil volume adjusting device is connected to the outdoor heat exchanger via a four-way valve, a third end of the oil volume adjusting device is connected to a gas return port of the compressor;

the oil volume adjusting device comprises a switch unit, an oil storage tank and an oil volume adjusting unit, wherein the oil storage tank and the oil volume adjusting unit are connected in series, the switch unit is provided between a refrigerant inlet of the oil storage tank and the oil storage tank;

the method comprises:

controlling the switch unit to open and controlling the oil volume adjusting unit to close to enable the oil storage tank to recover oil;

controlling the switch unit to close and controlling the multi-split system to perform a test run after a duration in which the oil is recovered to the oil storage tank reaches a first pre-set duration;

acquiring a pressure loss of a low-pressure piping and a refrigerant flow quantity during the test run of the multi-split system, and acquiring a pipe diameter of the low-pressure piping and a density of a low-pressure refrigerant in the multi-split system;

acquiring a redundant oil volume to be recovered according to the pressure loss of the low-pressure piping, the refrigerant flow quantity, the pipe diameter of the low-pressure piping and the density of the low-pressure refrigerant, and acquiring an oil volume to be discharged according to the redundant oil volume and a maximum oil storage volume of the oil storage tank;

controlling a difference between a high pressure and a low pressure of the multi-split system to be in a pre-set pressure range to acquire an oil discharging rate, acquiring an oil discharging duration according to the oil volume to be discharged and the oil discharging rate, and controlling a turn-on duration of the oil volume adjusting device to reach the oil discharging duration to discharge the oil volume to be discharged out of the multi-split system.

2. The method for adjusting the oil volume of the compressor of the multi-split system according to claim 1, wherein acquiring the redundant oil volume to be recovered according to the pressure loss of the low-pressure piping, the refrigerant flow quantity, the pipe diameter of the low-pressure piping and the density of the low-pressure refrigerant comprises:

acquiring an oil volume required by a current piping of the multi-split system according to the pressure loss of the low-pressure piping, the refrigerant flow quantity, the pipe diameter of the low-pressure piping and the density of the low-pressure refrigerant;

acquiring an additional-supplemented oil volume of the multi-split system;

subtracting the oil volume required by the current piping from the additional-supplemented oil volume to acquire the redundant oil volume.

3. The method for adjusting the oil volume of the compressor of the multi-split system according to claim 1, wherein the oil discharging duration is acquired according to the following formula:

$$t2=B*Q3/Qx,$$

where t2 is the oil discharging duration, B is a pre-set coefficient, Qx is the oil discharging rate, Q3 is the oil volume to be discharged, wherein $$Q3=Q2-Qz,$$

where Q2 is the redundant oil volume, and Qz is the maximum oil storage volume of the oil storage tank.

4. The method for adjusting the oil volume of the compressor of the multi-split system according to claim 1, wherein a first end of the oil separator is connected to the gas outlet of the compressor, a second end of the oil separator is connected to the second end of the oil volume adjusting device, and a third end of the oil separator is connected to the gas return port of the compressor via a first capillary tube and a first electromagnetic valve, respectively, the oil volume adjusting unit comprises a second capillary tube and a second electromagnetic valve in series, and the second capillary tube and the second electromagnetic valve in series are disposed between the gas return port of the compressor and an adjustment port of the oil storage tank, the switch unit comprises a third electromagnetic valve disposed between the gas outlet of the compressor and an inlet of the oil storage tank, and a refrigerant outlet of the oil storage tank is connected to the outdoor heat exchanger via the four-way valve.

5. An apparatus for adjusting an oil volume of a compressor of a multi-split system, wherein the multi-split system comprises an outdoor unit and a plurality of indoor units;

the outdoor unit comprises a compressor, an oil separator, an outdoor heat exchanger, an outdoor throttle valve, and an oil volume adjusting device;

the oil volume adjusting device and the oil separator are connected in parallel;

a first end of the oil volume adjusting device is connected to an gas outlet of the compressor, a second end of the oil volume adjusting device is connected to the outdoor heat exchanger via a four-way valve, a third end of the oil volume adjusting device is connected to a gas return port of the compressor;

the oil volume adjusting device comprises a switch unit, an oil storage tank and an oil volume adjusting unit, wherein the oil storage tank and the oil volume adjusting unit are connected in series, the switch unit is provided between a refrigerant inlet of the oil storage tank and the oil storage tank;

the apparatus comprises:

a controlling device configured to control the switch unit to open and control the oil volume adjusting unit to close to enable the oil storage tank to recover oil, and control the switch unit to close and control the multi-split system to perform a test run after a duration in which oil is recovered to the oil storage tank reaches a first pre-set duration;

an acquiring device configured to acquire a pressure loss of a low-pressure piping and a refrigerant flow quantity during the test run of the multi-split system, and acquire a pipe diameter of the low-pressure piping and a density of a low-pressure refrigerant in the multi-split system;

a calculating device configured to acquire a redundant oil volume to be recovered according to the pressure loss of the low-pressure piping, the refrigerant flow quantity, the pipe diameter of the low-pressure piping and the density of the low-pressure refrigerant, and acquire an oil volume to be discharged according to the redundant oil volume and a maximum oil storage volume of the oil storage tank;

wherein the controlling device is further configured to control a difference between a high pressure and a low pressure of the multi-split system to be in a pre-set pressure range to acquire an oil discharging rate, acquire an oil discharging duration according to the oil volume to be discharged and the oil discharging rate, and control a turn-on duration of the oil volume adjusting device to reach the oil discharging duration to discharge the oil volume to be discharged out of the multi-split system.

6. The apparatus for adjusting the oil volume of the compressor of the multi-split system according to claim 5, wherein the calculating device is further configured to:

acquire an oil volume required by a current piping of the multi-split system according to the pressure loss of the low-pressure piping, the refrigerant flow quantity, the pipe diameter of the low-pressure piping and the density of the low-pressure refrigerant;

acquire an additional-supplemented oil volume of the multi-split system;

subtract the oil volume required by the current piping from the additional-supplemented oil volume to acquire the redundant oil volume.

7. The apparatus for adjusting the oil volume of the compressor of the multi-split system according to claim 5, wherein the controlling device acquires the oil discharging duration according to the following formula:

$$t2=B*Q3/Qx,$$

where t2 is the oil discharging duration, B is a pre-set coefficient, Qx is the oil discharging rate, Q3 is the oil volume to be discharged, wherein $$Q3=Q2-Qz,$$

where Q2 is the redundant oil volume, and Qz is the maximum oil storage volume of the oil storage tank.

8. The apparatus for adjusting the oil volume of the compressor of the multi-split system according to claim 5, wherein a first end of the oil separator is connected to the gas outlet of the compressor, a second end of the oil separator is connected to the second end of the oil volume adjusting device, and a third end of the oil separator is connected to the gas return port of the compressor via a first capillary tube and a first electromagnetic valve, respectively, the oil volume adjusting unit comprises a second capillary tube and a second electromagnetic valve in series, and the second capillary tube and the second electromagnetic valve in series are disposed between the gas return port of the compressor and an adjustment port of the oil storage tank, the switch unit comprises a third electromagnetic valve disposed between the gas outlet of the compressor and an inlet of the oil storage tank, and a refrigerant outlet of the oil storage tank is connected to the outdoor heat exchanger via the four-way valve.

9. A multi-split system, comprising the apparatus for adjusting the oil volume of the compressor of the multi-split system according to claim 5.

* * * * *